US008361688B2

(12) United States Patent
Kouyama et al.

(10) Patent No.: US 8,361,688 B2
(45) Date of Patent: Jan. 29, 2013

(54) TONER

(75) Inventors: Mikio Kouyama, Tokyo (JP); Kenji Hayashi, Tokyo (JP); Hiroaki Obata, Tokyo (JP); Noriyuki Kinpara, Tokyo (JP); Hiroshi Nagasawa, Tokyo (JP); Yasuhiko Muramatsu, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 474 days.

(21) Appl. No.: 12/652,821

(22) Filed: Jan. 6, 2010

(65) Prior Publication Data

US 2010/0178606 A1 Jul. 15, 2010

(30) Foreign Application Priority Data

Jan. 13, 2009 (JP) ..... 2009-004501

(51) Int. Cl.
*G03G 9/087* (2006.01)

(52) U.S. Cl. ..... 430/108.4

(58) Field of Classification Search ..... 430/108.4
See application file for complete search history.

(56) References Cited

U.S. PATENT DOCUMENTS 5,741,617 A * 4/1998 Inaba et al. ..... 430/108.4
5,998,080 A * 12/1999 Ohno et al. ..... 430/110.4
6,602,644 B2 * 8/2003 Matsushima et al. ..... 430/108.4
6,967,070 B2 * 11/2005 Nakamura et al. ..... 430/108.4
7,470,496 B2 * 12/2008 Koyama et al. ..... 430/108.4
7,622,233 B2 * 11/2009 Patel et al. ..... 430/108.4
7,998,648 B2 * 8/2011 Lee et al. ..... 430/108.4
8,080,359 B2 * 12/2011 Matsubara et al. ..... 430/108.4

FOREIGN PATENT DOCUMENTS

| | | |
|---|---|---|
| JP | 2002162778 | 6/2002 |
| JP | 2006133749 | 5/2006 |
| JP | 2007114648 | 5/2007 |
| JP | 2008191652 | 8/2008 |

* cited by examiner

*Primary Examiner* — Christopher Rodee
(74) *Attorney, Agent, or Firm* — Lucas & Mercanti, LLP

(57) ABSTRACT

Disclosed is a toner including: a resin; coloring agent and release agent including compound or compounds represented by the following general formula (1): $R_1$—(COO—$R_2$)$_n$, wherein $R_1$ is a linking group having carbon number of 2 to 8 which may be a cyclic structure and may have a hydroxy group or fatty acid ester group; and each $R_2$ is an alkyl group having carbon number of N, (N-2) or (N-4) independently, N is a natural number from 10 to 30, and n is a natural number from 3 to 4, $R_2$ with carbon number of N is 80 to 97 percent by mass, $R_2$ with carbon number of (N-2) is 0.0 to 7.8 percent by mass, $R_2$ with carbon number of (N-4) is 3.0 to 13.0 percent by mass, $R_2$ with carbon number of (N-4) is included 1.5 percent by mass or more than $R_2$ with carbon number of (N-2).

5 Claims, No Drawings

TONER

CROSS REFERENCE TO RELATED APPLICATION

This Application claims the benefit of priority of Japanese Patent Application No. 2009-004501, filed Jan. 13, 2009, the entire contents of which are hereby incorporated by reference.

BACKGROUND

1. Field of the Invention

The present invention relates to toner, especially a toner for developing an electrostatic latent image.

2. Description of Related Art

Lately, there is a rising demand for a more energy conserving image forming apparatus which performs image forming by electro-photography and toner which can be fixed at a low temperature is being developed.

In order to realize fixing at a low temperature, the binder resin and release agent in the toner need to be melted at a low fixing temperature. Therefore, typically, as binder resin and release agent in the toner, those with low melt viscosity are generally used.

In order to adapt to a much lower fixing temperature, a toner is disclosed in which the release agent has a lower melting temperature (for example, see Japanese Patent Application Laid-Open Publication No. 2002-162778, Japanese Patent Application Laid-Open Publication No. 2006-133749). However, further lowering of the fixing temperature results in the toner melting easily, and there is a problem that when sheets of paper on which fixing processing of the toner images are performed by double face printing are piled, a toner image on one sheet of paper soils a toner image of a contacting sheet of paper, and document offset occurs. Therefore, a toner where document offset does not occur is developed (for example, see Japanese Patent Application Laid-Open Publication No. 2007-114648).

Further, in a toner which can be fixed at a low temperature, the gloss of the toner image tends to be better, however gloss unevenness also increases. Therefore, there is a toner developed to even gloss and also to enable fixing at a low temperature (for example, see Japanese Patent Application Laid-Open Publication No. 2008-191652).

However, the ability to prevent document offset and to even gloss is still not enough.

SUMMARY

The present invention has been made in consideration of the above problems, and it is one of main objects to provide a toner which realizes even gloss and prevents document offset.

In order to achieve at least one of the above described objects, according to an aspect of the present invention, there is provided a toner for developing an electrostatic latent image including:

a resin;

a coloring agent and a release agent comprising a compound or compounds represented by the following general formula (1):

$$R_1—(COO—R_2)_n$$

wherein $R_1$ shown in the general formula (1) is a linking group having carbon number of 2 to 8 which may be a cyclic structure and may have a hydroxy group or fatty acid ester group; and each $R_2$ shown in the general formula (1) is an alkyl group having carbon number of N, (N-2) or (N-4) independently, N is a natural number from 10 to 30, and n is a natural number from 3 to 4, wherein $R_2$ with carbon number of N is 80 to 97 percent by mass based on the mass of total $R_2$s in the release agent, $R_2$ with carbon number of (N-2) is 0.0 to 7.8 percent by mass based on the mass of total $R_2$s in the release agent, $R_2$ with carbon number of (N-4) is 3.0 to 13.0 percent by mass based on the mass of total $R_2$s in the release agent;

$R_2$ with carbon number of (N-4) is included 1.5 percent by mass or more than $R_2$ with carbon number of (N-2) in the release agent.

DETAILED DESCRIPTION OF PREFERRED EMBODIMENTS

A preferred embodiment reflecting an aspect of the present invention is described in detail. However, the scope of the invention is not limited to the illustrated examples.

The toner of the present embodiment is described.

<Toner>

The toner for developing an electrostatic latent image of the present embodiment includes:

a resin;

a coloring agent and a release agent comprising a compound or compounds represented by the following general formula (1):

$$R_1—(COO—R_2)_n$$

wherein $R_1$ shown in the general formula (1) is a linking group having carbon number of 2 to 8 which may be a cyclic structure and may have a hydroxy group or fatty acid ester group; and each $R_2$ shown in the general formula (1) is an alkyl group having carbon number of N, (N-2) or (N-4) independently, N is a natural number from 10 to 30, and n is a natural number from 3 to 4, wherein $R_2$ with carbon number of N is 80 to 97 percent by mass based on the mass of total $R_2$s in the release agent, $R_2$ with carbon number of (N-2) is 0.0 to 7.8 percent by mass based on the mass of total $R_2$s in the release agent, $R_2$ with carbon number of (N-4) is 3.0 to 13.0 percent by mass based on the mass of total. $R_2$s in the release agent;

$R_2$ with carbon number of (N-4) is included 1.5 percent by mass or more than $R_2$ with carbon number of (N-2) in the release agent.

The toner of the present embodiment can have a core shell structure.

(Resin)

The resin used in the toner of the present embodiment is not limited. A polymer formed by polymerizing polymerizable monomer called vinyl series monomer described below is a representative example. Also, polyester resin can also be used. Further, the polymer composing the resin which can be used in the present embodiment includes as a component a polymer obtained by polymerizing at least one type of polymerizable monomer and is a polymer which is made by a sole polymerizable monomer or by a combination of a plurality of types of polymerizable monomers.

Below, specific examples of vinyl series polymerizable monomers are described.

(1) Styrene or Styrene Derivative

Examples are, styrene, o-methyl styrene, m-methyl styrene, p-methyl styrene, a-methyl styrene, p-ethyl styrene, 2,4-dimethyl styrene, p-tert-butyl styrene, p-n-hexyl styrene, p-n-octyl styrene, p-n-nonyl styrene, p-n-decyl styrene and p-n-dodecyl styrene.

(2) Methacrylate Ester Derivative

Examples are, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, phenyl methacrylate, diethylaminoethyl methacrylate and dimethylaminoethyl methacrylate.

(3) Acrylate Ester Derivative

Examples are, methyl acrylate, ethyl acrylate, isopropyl acrylate, n-butyl acrylate, t-butyl acrylate, isobutyl acrylate, n-octyl acrylate, 2-ethylhexyl acrylate and phenyl acrylate.

(4) Vinyl Esters

Examples are, vinyl propionate, vinyl acetate, benzoate vinyl, etc.

(5) Vinyl Ethers

Examples are, vinyl methyl ether, vinyl ethyl ether, etc.

(6) Vinyl Ketones

Examples are, vinyl methyl ketone, vinyl ethyl ketone, vinyl hexyl ketone, etc.

(7) Others

Examples are, acrylic acid or methacrylic acid derivatives such as acrylonitrile, methacrylonitrile, acrylamide, etc.

Also, as polymerizable monomer of the vinyl series composing resin which can be used in the toner of the present embodiment, those including ionic dissociable group as described below can be used. Especially, when using a coloring agent which is slightly alkaline, it is preferable to use a monomer including the ionic dissociable group in the side chain, such as carboxyl group, sulfonic acid group, phosphoric acid group, etc., because the dispersion in the resin can be enhanced.

Specifically, monomers including the carboxyl group are, acrylic acid, methacrylic acid, maleic acid, itaconic acid, cinnamic acid, fumaric acid, etc. Also, monomers including sulfonic acid group are styrene sulfonic acid, allyl sulfosuccinic acid, 2-acrylamide-2-methylpropane sulfonic acid, etc. Monomers including phosphoric acid group are, acid phosphor oxy ethyl methacrylate, etc.

Also, by using polyfunctional vinyl series described below, a resin with a bridged structure can be made. Specific examples of polyfunctional vinyl series are, divinyl benzene, ethylene glycol dimethacrylate, ethylene glycol diacrylate, diethylene glycol dimethacrylate, neopentyl glycol dimethacrylate, neopentyl glycol diacrylate, etc.

Further, the non-crystalline polyester resin described below can be used.

Publicly known polyester resin can be used as the non-crystalline polyester resin used in the present embodiment. The non-crystalline polyester resin can be synthesized from a multivalent carboxylic acid component and polyhydric alcohol component. Incidentally, as the non-crystalline polyester resin, a commercialized product or a synthesized resin can be used. Also, the non-crystalline polyester resin can be one type of non-crystalline polyester resin or can be a mixture of two or more types of non-crystalline polyester resin.

Examples of the polyhydric alcohol component which can be used in the non-crystalline polyester resin are, for example divalent alcohol components such as, ethylene glycol, propylene glycol, 1,4-butanediol, 2,3-butanediol, diethylene glycol, triethylene glycol, 1,5-pentanediol, 1,6-hexanediol, neopentylene glycol, 1,4-cyclohexanedimethanol, dipropylene glycol, polyethylene glycol, polypropylene glycol, bisphenol A, hydrogenated bisphenol A, etc. Also, trivalent or more alcohol components which can be used are, glycerin, sorbitol, 1,4-sorbitan, trimethylolpropane, etc.

Also, as a divalent carboxylic acid component to be condensed with the above polyhydric alcohol component, the following can be used, for example, aromatic carboxylic acids such as terephthalic acid, isophthalic acid, phthalic anhydride, trimellitic anhydride, pyromellitic acid, naphthalene dicarboxylic acid, etc.; aliphatic carboxylic acids such as maleic anhydride, fumaric acid, succinic acid alkenyl succinic acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, 1,18-octadecane dicarboxylic acid, etc.; alicyclic carboxylic acids such as cyclohexane dicarboxylic acid, etc.; and lower alkyl ester, acid anhydride, etc. of these acids. One type or two or more types of these acids can be used.

Among such multivalent carboxylic acids, when especially alkenyl succinic acid or its anhydride is used, there is an alkenyl group with higher hydrophobic property compared to other functional groups and is more easily soluble to crystalline polyester resin. Examples of alkenyl succinic acid are, n-dodecyl succinic acid, n-dodecenyl succinic acid, isododecyl succinic acid, isododecenyl succinic acid, n-octyl succinic acid, n-octenyl succinic acid or acid anhydride, acid chloride, or lower alkyl ester with carbon number of 1 to 3 of these acids.

Further, by including a trivalent or more carboxylic acid, the polymer chain can be a bridged structure, and by forming a bridged structure, reduce of modulus of elasticity at a high temperature range can be prevented and offset in the high temperature range can be enhanced.

As trivalent or more carboxylic acid, there are for example, trimellitic acids such as 1,2,4-benzenetricarboxylic acid or 1,2,5-benzenetricarboxylic acid, 1,2,4-naphthalenetricarboxylic acid, hemimellitic acid, trimesic acid, mellophanic acid, prehnitic acid, pyromellitic acid, mellitic acid, 1,2,3,4-butanetetracarboxylic acid or acid anhydride, acid chloride, or lower alkyl ester with carbon number of 1 to 3 of these acids. It is especially suitable to use trimellitic acid. One type of these acids can be used alone or two or more types can be used together.

Also, it is preferable that other than the above described aliphatic dicarboxylic acid or aromatic dicarboxylic acid, a dicarboxylic acid component with a sulfonic acid group is included as an acid component. The dicaroxylic acid including the sulfonic acid group is effective in that color material such as pigment can be dispersed well. Also, when dispersion liquid of the resin particle is made by emulsifying or suspending the entire resin in water, if the dicarboxylic acid component includes the sulfonic acid group, emulsification or suspension can be performed without using a surfactant.

From the above reasons, it is desirable that the non-crystalline polyester resin includes a component made by a reaction including at least one type from alkenyl succinic acid and its anhydride and at least one type from trimellitic acid and its anhydride. It is desirable that this component is included in the polymer component of the non-crystalline polyester resin to mainly function in solution with the crystalline polyester resin and fixing of the crystalline polyester resin.

(Coloring Agent)

Carbon black, magnetic material, dye, pigment, etc. can be arbitrarily used as a coloring agent. Also, the number average of initial particle diameter is different according to type and it is preferable that it is about 10 to 200 nm.

As a black coloring agent, carbon black such as furnace black, channel black, acetylene black, thermal black, lamp black, etc., or magnetic powder such as magnetite, ferrite, etc. can be used.

As a coloring agent for color, coloring agent of magenta (or red), yellow (or orange), cyan (or green), etc. can be used, and pigment and dye already known can be used. Examples of magenta coloring agents are pigment such as C.I. pigment red 5, said 48:1, said 53:1, said 57:1, said 122, said 139, said 144, said 149, said 166, said 177, said 178, said 222, etc. and dye such as C.I. solvent red 1, said 49, said 52, said 58, said 68, said 11, said 122, etc. Examples of yellow coloring agents are pigment such as C.I. pigment yellow 14, said 17, said 74, said 93, said 94, said 138, said 155, said 180, said 185, C.I. pigment orange 31, said 43, etc. and dye such as C.I. solvent yellow 19, said 44, said 77, said 79, said 81, said 82, said 93, said 98, said 103, said 104, said 112, said 162, etc. Examples of cyan coloring agents are pigment such as C.I. pigment blue 15:3, said 60, C.I. pigment green 7, etc. and dye such as C.I. solvent blue 25, said 36, said 69, said 70, said 93, said 95, etc. Also, these can be mixed.

The amount of adding these coloring agents is 3 to 10 percent by mass, preferably 4 to 8 percent by mass in the toner.

(Release Agent)

The release agent of the present embodiment includes a compound or compounds represented by the following general formula (1):

$$R_1—(COO—R_2)_n$$

wherein $R_1$ shown in the general formula (1) is a linking group having carbon number of 2 to 8 which may be a cyclic structure and may have a hydroxy group or fatty acid ester group; and each $R_2$ shown in the general formula (1) is an alkyl group having carbon number of N, (N-2) or (N-4) independently, N is a natural number from 10 to 30, and n is a natural number from 3 to 4, wherein $R_2$ with carbon number of N is 80 to 97 percent by mass based on the mass of total $R_2$s in the release agent, $R_2$ with carbon number of (N-2) is 0.0 to 7.8 percent by mass based on the mass of total $R_2$s in the release agent, $R_2$ with carbon number of (N-4) is 3.0 to 13.0 percent by mass based on the mass of total $R_2$s in the release agent;

$R_2$ with carbon number of (N-4) is included 1.5 percent by mass or more than $R_2$ with carbon number of (N-2) in the release agent.

The release agent shown by the above described general formula (1) can be obtained by an ester reaction of multivalent carboxylic acid and monohydric alcohol.

As carboxylic acid components, there are, for example dicarboxylic acid, tricarboxylic acid, oxy-multivalent carboxylic acids, tetra carboxy methane, piromellitic acid, ethylenediaminetetraacetic acid (EDTA), etc. As dicarboxylic acid, there are for example, oxalic acid, malonic acid, succinic acid, glutaric acid, adipic acid, pimelic acid, maleic acid, fumaric acid, phthalic acid, etc. Also as tricarboxylic acid, there are for example, trimellitic acid, propane-1,2,3-tricarboxylic acid, prop-1-ene-1,2,3-tricarboxylic acid. As oxy-multivalent carboxylic acids, there are for example, oxydicarboxylic acids such as malic acid and tartaric acid, and oxytricarboxylic acids such as citric acid, isocitric acid.

$R_1$ of the general formula (1) is a linking group linked to the carbon atom composing the ester group linked to $R_2$, and the carbon atom composing the ester group and the carbon atom composing the linking group $R_1$ are covalently linked.

$R_2$ of the general formula (1) is derived from an alkyl group of the monohydric alcohol component linked with ester.

The monohydric alcohol is selected to satisfy that $R_2$ with carbon number of N is 80 to 97 percent by mass based on the mass of total $R_2$ groups in the release agent, $R_2$ with carbon number (N-2) is 0.0 to 7.8 percent by mass based on the mass of total $R_2$ groups in the release agent, $R_2$ of the carbon number of (N-4) is 1.0 to 13.0 percent by mass based on the mass of total $R_2$ groups in the release agent, and $R_2$ with carbon number of (N-4) is included 1.5 percent by mass or more than $R_2$ with carbon number of (N-2) in the release agent. The monohydric alcohol is added to the acid component of the multivalent carboxylic acid and by finishing the ester reaction and the release agent comprising a compound or compounds represented by general formula (1) can be obtained.

Here, the mass ratio of $R_2$ with each carbon number can be calculated by hydrolyzing the ester compound which is the release agent shown in the general formula (1) and the obtained monohydric alcohol components are analyzed by a method using, GPC, liquid chromatography, mass spectrometer, etc. Alternatively, calculation can be performed by analyzing a commercially available monohydric alcohol reagent as a sample.

In order to enhance document offset, it is preferable that the $R_2$ group is a straight alkyl group.

Usually, when a material including a component such as natural fatty acid, etc., monohydric alcohol component of carbon number of (N-4) does not exceed monohydric alcohol component of carbon number of (N-2) and therefore, the alcohol ratio is adjusted before reaction or an ester compound including an alcohol component with a different carbon number is included to obtain the release agent shown in the above described general formula (1).

Also, in order to enhance document offset, it is preferable that the release agent comprising a compound or compounds shown by the above described general formula (1) includes 2 to 15 percent of monohydric alcohol with carbon number of N which is not esterified, and it is even more preferable if the percentage is 3 to 8 percent. The monohydric alcohol with carbon number of N can be dissolved in the compound of the general formula (1), which is in a melted state, after ester synthesis, or an amount of equivalent or more can be prepared and left at the time of ester synthesis.

In the general formula (1), N is to be 10 to 30, however in order to further enhance balance of fixing at a low temperature and document offset, it is preferable that N is 12 to 26.

As for the release agent comprising a compound or compounds shown by the general formula (1), the $R_2$ groups of carbon number N, N-2, N-4 are to be included at the content percentage defined by the general formula (1) based on the mass of total $R_2$s. The release agent can be a mixture of ester compounds each of which includes only $R_2$ group of carbon numbers N, N-2 or N-4 as described below in the formulae (1a) to (1c) or can be only an ester compound where $R_2$ groups with different carbon numbers such as those described below in the formulae (1d), (1e) or (1f). Also, the release agent can be a mixture of the ester compounds each shown by the formulae (1a) to (1f) described below.

[Chemical 1]

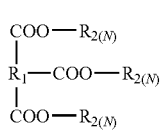

(1a)

-continued (1b)

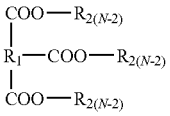

(1c)

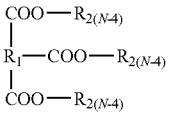

(1d)

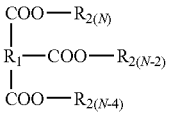

(1e)

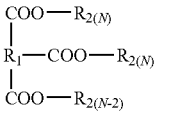

(1f)

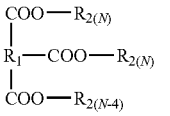

In the above described formulae (1a) to (1f), $R_{2(N)}$ is the alkyl group with carbon number of N, $R_{2(N-2)}$ is the alkyl group with carbon number of N-2, $R_{2(N-4)}$ is the alkyl group with carbon number of N-4.

The following formulae show example compounds of the release agent shown by the general formula (1). The example compounds are an example of an ester compound where an alkyl group of the main carbon number N is the $R_2$ group, however, the embodiment is not limited to this example.

[Chemical 2]

(1-1)

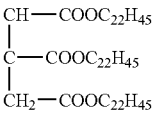

(1-2)

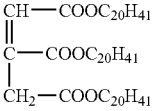

(1-3)

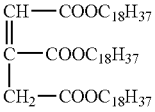

(1-4)

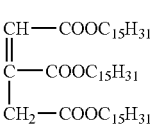

(1-5)

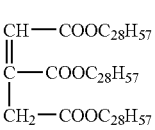

-continued (1-6)

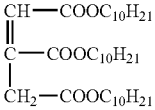

(1-7)

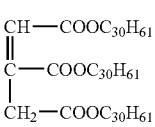

(1-8)

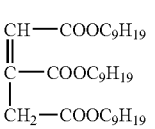

(1-9)

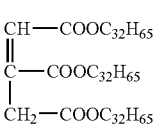

[Chemical 3]

(3-1)

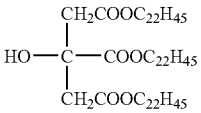

(3-2)

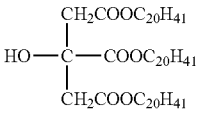

(3-3)

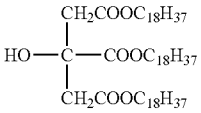

(3-4)

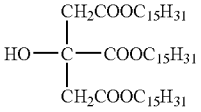

(3-5)

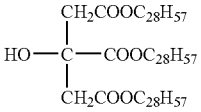

(3-6)

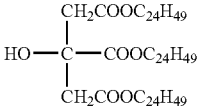

(3-7)

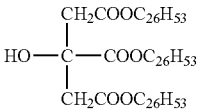

(3-8)

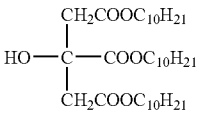

-continued (3-9)

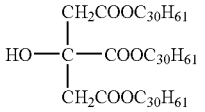

(3-10)

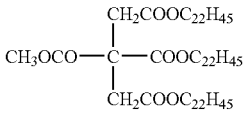

(3-11)

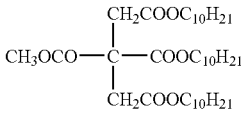

(3-12)

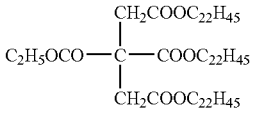

(3-13)

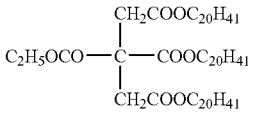

(3-14)

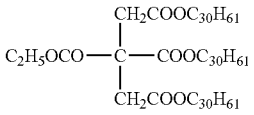

(3-15)

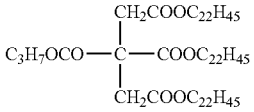

(3-16)

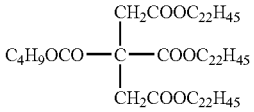

(Charge Control Agent)

A charge control agent can be added to the toner of the present embodiment to stabilize charging or to enhance start-up of charging.

Well-known charge control agents can be used as the charge control agent such as, dye of nigrosine series, metallic salt of naphthene acid or higher fatty acid, alkoxylated amine, quaternary ammonium chloride, azo-series metal complex, metallic salt of salicylic acid, or metal complex thereof, etc. Metal used as the metal complex are for example, Al, B, Ti, Fe, Co, Ni, etc. Metal complex compound of the salicylic acid derivative is especially preferable for the charge control agent. The amount of charge control agent included in the toner is 0.1 to 20 percent by mass of the entire toner.

(External Additive)

In order to enhance flowability, cleaning properties, and charging properties, the toner of the present embodiment can include an external additive.

As the external additive, there are examples such as, inorganic particle, organic fine particle, lubricant, etc.

As for the inorganic particles, there are those with small diameters and large diameters, and examples of those with small diameters (initial particle diameter is about 7 to 25 nm) are, silica, titanic, alumina, strontium titanate, etc. and flowability and charging properties can be enhanced. Preferable inorganic particles with large diameters (initial particle diameter is about 0.1 to 1 μm) are, spherical silica, titanic acid compound such as strontium titanate, etc., titanium oxide, hydroxy talcite, and transferring properties and cleaning properties can be enhanced. It is preferable that the inorganic particles are subjected to hydrophobizing processing by silane coupling agent, titanium coupling agent or the like.

<Toner Manufacturing Method>

The toner of the present embodiment can be manufactured by a known manufacturing method such as grinding method, suspension polymerization method, emulsion aggregation method, etc.

Below, as an example of a toner manufacturing method of the present embodiment, a method using the emulsion aggregation method to manufacture toner with a core shell structure is described.

(1) Core Resin Particle Emulsion Step

In this step, the particle which is to be the core section of the toner is manufactured. First, the resin particle which is to be the binder resin of the core section is emulsified. It is preferable that the emulsified resin particle is 30 to 300 nm. For example, a dispersion liquid for the core resin particle is prepared by emulsifying and dispersing polymerizable monomer and then adding a polymerization initiator to advance polymerization reaction. The resin particle can be prepared without using the polymerization reaction by dissolving or dispersing the release agent or coloring agent in a solvent depending on the resin and necessity and then dispersing in an aqueous medium and draining the solvent. At this time, when the release agent shown by the general formula (1) is dissolved in the polymerizable monomer or resin solution to prepare the emulsified (dispersed) liquid, the release agent particle detaches after the toner particle is completed. This is preferable because contamination of members of the image forming apparatus can be prevented.

(2) Flocculation/Fusion Step

The dispersion liquid of the coloring agent particle is added to the above described dispersion liquid for the core resin particle and the dispersion liquid of the release agent particle is added as necessary. Next, the flocculating agent is added, and when the core resin particle, coloring agent particle, release agent particle is added in the aqueous medium, further added release agent particle is flocculated and fused to form the core particle. The string of steps of flocculation and fusion is also called the aggregation step.

It is preferable to use a salting out fusion method as a method of flocculation and fusion. The salting out fusion method is a method where flocculation and fusion is concurrently performed, and when the core particle is developed to a desired particle diameter, a terminating agent of the flocculation is added to stop the development of the particle. In this method, heating is continuously performed to control the particle shape as necessary.

As the size of the core particle, it is preferable that the median diameter on a volumetric basis is 3 to 10 μm, and it is especially preferable that the size is 3 to 7 μm. The median diameter of the core particle on a volumetric basis is measured and calculated by using an apparatus where a computer system (manufactured by Beckman Coulter, Inc.) including data processing software "Software V3.51" is connected to the Coulter Multisizer 3 (manufactured by Beckman Coulter, Inc.).

As a measuring sequence, 0.02 g of a specimen is blended in 20 ml of a surfactant solution (a surfactant solution where, for example a neutral detergent including a surfactant component is diluted by ten times in pure water for the purpose of dispersing a specimen) ultrasonic dispersion is performed for one minute to prepare a dispersion liquid of the specimen. The prepared dispersion liquid is injected with a pipette in a beaker including ISOTON II (manufactured by Beckman Coulter, Inc.) in the sample stand until the displayed concentration of the measuring instrument is 5 to 10 percent. With this concentration range, a reproducible measured value can be obtained. In the measurement instrument, the measured particle count is to be 25000, the aperture diameter is to be 50 μm, and the frequency value is calculated by dividing the measured range of 1 to 30 μm into 256 portions. The particle diameter at 50 percent starting from the largest volume integrated fraction is to be the median diameter on a volumetric basis.

The aqueous medium is a medium where the primary component (50 percent by mass or more) is water. As a component other than water, there is an organic solvent which dissolves in water. For example, there are methanol, ethanol, isopropanol, butanol, acetone, methyl ethyl ketone, tetrahydrofuran, etc.

After the flocculation and fusion step, the processing can go through an aging step.

Specifically, the heating temperature is kept low in the flocculation and fusion step so that the progress of the fusion between particles is suppressed and the core particle is even. Then, in the aging step, it is controlled to keep the heating temperature low and the heating time long so that the surface of the core particle is an even shape.

(3) Shell Forming Step

In the shell forming step, a dispersion liquid of the shell resin particle is added to the dispersion liquid of the core particle. The dispersion liquid can be a dispersion liquid of a resin particle with the same composition as a well known binder resin particle for toner, and can also be a dispersion liquid of a resin particle same as the core resin particle. In order to balance both preserving properties against heat and fixing properties at low temperatures, it is preferable that the copolymerization ratio is set so that the glass transition temperature is 5° C. to 25° C. higher than the core resin particle.

In the shell forming step, the shell resin particle is fused to the surface of the core particle, and a shell layer can be thinly formed to cover the entire surface of the core particle.

(4) Cooling/Cleaning Step

In the cooling and cleaning step, the dispersion liquid of the toner particle obtained by the shell forming step is cooled at a cooling rate of, for example 1° C. to 20° C./min. When cooled to a predetermined temperature, solid-liquid separation of the toner particle from the cooled dispersion liquid of the toner particle is performed. The solid-liquid separation can be performed by centrifugal separation, filtration under reduced pressure using a nutsche, etc., filtration using a filter press, etc. or any other method. Next, a toner cake (toner particles in a wet state shaped in a cylinder like a cake) obtained by solid-liquid separation is cleaned and attached matter such as surfactant solution, salting out solution and the like are removed.

(5) Drying Step

In the drying step, drying processing is performed on the cleaned toner cake. In the drying processing, a spray dryer, vacuum freeze dryer, reduced pressure dryer, etc. can be used. It is preferable that the moisture of the dried toner particle is 5 percent by mass or lower and it is more preferable that it is 2 percent by mass or lower.

(6) External Additive Processing Step

In the external additive processing step, the external additive is mixed in the toner particle obtained by the drying step to obtain toner for electrical static charge developing.

<Developer Manufacturing>

For example, the toner of the present embodiment is presumed to be used as a one component magnetic toner including a magnetic material, to be used as a two component developer mixed with a commonly called carrier, to solely use the nonmagnetic toner, etc., and the toner of the present embodiment can be used suitably in any situation.

When the toner of the present embodiment is used as a two component developer mixed with a carrier, occurrence of toner filming (carrier pollution) to the carrier can be suppressed. When the toner of the present embodiment is used as a one component developer, occurrence of toner filming to the frictional electrification member of the developing device can be suppressed.

As a carrier included in the two component developer, a magnetic particle composed of a conventionally well known material including metal such as iron, ferrite, magnetite, etc., alloy of such metal and metal such as aluminum, lead, etc., and the like can be used. It is especially preferable to use a ferrite particle.

As a carrier, it is preferable that the volumetric average particle diameter is 15 to 100 μm, and more preferable that it is 25 to 60 μm. Typically, the measurement of the volumetric average particle diameter of the carrier can be measured by a laser diffraction particle size distribution measurement apparatus "HELOS" (manufactured by SYMPATEC) which includes a wet type disperser.

As a carrier, it is preferable to use one which is covered by a resin or a commonly called resin dispersion carrier where a magnetic particle is dispersed in the resin. The resin composition for covering is not limited and examples which can be used are, olefin series resin, styrene series resin, styrene-acrylic series resin, silicon series resin, ester series resin or fluorine included polymer series resin, etc. Also, resin to compose the resin dispersion carrier are not limited and those well known can be used, for example, styrene-acrylic series resin, polyester series resin, fluorine series resin, phenol series resin, etc.

<Image Forming Method>

The above described toner can be suitably used in an image forming method including a fixing step by a contact heating method. As an image forming method, specifically, the above described toner is used to obtain a toner image by for example, exposing an electrostatic latent image electrostatically formed on the image supporting member by charging a developer in the developing device with a frictional electrification member. Then, the toner image is transferred onto a paper and then the toner image transferred onto the paper is fixed on the paper by fixing processing by the contact heating method and a visible image is obtained.

<Fixing Method>

As a suitable fixing method which uses the toner of the present embodiment, there is the commonly called contact heating method. As the contact heating method, there is a thermal compression fixing method, thermal roller fixing method, and pressure welding heating fixing method which is fixing by a rotating pressurizing member which internally includes a fixedly positioned heated body.

The fixing method of the thermal roll fixing method typically uses a fixing device composed of an upper roller including a heat source inside a metal cylinder including iron, aluminum, etc., covered on the surface with fluorine resin, etc. and a lower roller formed from silicone rubber, etc.

As a heat source, a linear heater is used, and the surface temperature of the upper roller is heated by the heater to about 120° C. to 200° C. Pressure is applied between the upper roller and the lower roller and since the lower roller is deformed by the pressure, a commonly called nip is formed in the deformed section. The width of the nip is 1 to 10 mm, and preferably 1.5 to 7 mm. It is preferable that the fixing linear speed is 40 mm/sec to 600 mm/sec. When the width of the nip is too small, heat cannot be applied evenly to the toner and there is a possibility that fixing unevenness occurs. On the other hand, when the width of the nip is too large, the melting of the polyester resin included in the toner particle is enhanced and there is a possibility that fixing offset occurs.

EXAMPLE

Below, a specific example of the present embodiment is described, however the present invention is not limited to this example.

Toners 1 to 15 of the present example and comparative toners 1 to 9 of the comparative example were made. Developers were prepared using each toner made and an evaluation experiment was performed using the developers.

1. Preparation of Material (1) Manufacturing of Release Agent 1

Four flasks on which a thermometer, nitrogen introduction tube, agitator and cooling tube were applied were added with 1020 parts by mass (10.0 mol) of citric acid as an acid component and the following alcohol family as the alcohol component.

(Alcohol Family)

Arachyl alcohol (carbon number N=20): 7531.0 parts by mass Octadecyl alcohol (carbon number (N-2)=18): 325.3 parts by mass Cetyl alcohol (carbon number (N-4)=16): 483.7 parts by mass Further, 80 parts by mass of methasulfonic acid was added and under a nitrogen stream, while distilling reaction water at 120° C., reaction was continued for five hours under atmospheric pressure. 100 parts by mass of the obtained esterified composition was added with 100 parts by mass of 1 percent potassium hydrate aqueous solution and agitated for 30 minutes at 90° C. Then, after placing in a still state for 30 minutes, the aqueous layer was removed and the deoxidation step ended. Next, 100 parts by mass of the used esterified composition was added with 20 parts by mass of ion exchange water and 5 parts by mass of arachyl alcohol and after agitating for 30 minutes at 70° C. and placing in a still state for 30 minutes, the aqueous layer was separated and removed. Washing with water was repeated four times until the pH of the discharge water was neutral. The moisture of the remaining ester layer was distilled at 180° C. and filtered to obtain an ester wax with a melting point of 76.1° C. to be the release agent 1. The arachyl alcohol which was not esterified in the release agent 1 was 5.6 percent by mass.

Table 1 shows a compound name of the carboxylic acid used as the acid component of the release agent 1, the carbon number M of the $R_1$ group, valence n, main carbon number N of the $R_2$ group of the release agent 1, and content percentage (percent by mass) based on the mass of the entire $R_2$s of the alkyl group of the carbon numbers N, N-2, N-4 included in the release agent 1. In the content percentage, the combination of C and the number show the carbon number, and for example, C16 shows carbon number 16. The content percentage shown in table 1 are derived from the content amount of the monohydric alcohol where hydroxy group is bonded to each $R_2$ group with carbon number of N, N-2, N-4, in other words, the monohydric alcohol which is to be the material for the ester compound.

TABLE 1

| | ACID COMPONENT | | | ALCOHOL COMPONENT | | | | | |
|---|---|---|---|---|---|---|---|---|---|
| RELEASE | | $R_1$ CARBON | | $R_2$ CARBON | CONTENT PERCENTAGE, PERCENT BY MASS | | | | |
| AGENT | COMPOUND NAME | NUMBER M | VALENCE n | NUMBER N | C4 | C6 | C8 | C10 | C12 |
| RELEASE AGENT 1 | CITRIC ACID | 3 | 3 | 20 | | | | | |
| RELEASE AGENT 2 | CITRIC ACID | 3 | 3 | 22 | | | | | |
| RELEASE AGENT 3 | CITRIC ACID | 3 | 3 | 22 | | | | | |
| RELEASE AGENT 4 | CITRIC ACID | 3 | 3 | 22 | | | | | |
| RELEASE AGENT 5 | CITRIC ACID | 3 | 3 | 22 | | | | | |
| RELEASE AGENT 6 | CITRIC ACID | 3 | 3 | 22 | | | | | |
| RELEASE AGENT 7 | CITRIC ACID | 3 | 3 | 28 | | | | | |
| RELEASE AGENT 8 | CITRIC ACID | 3 | 3 | 30 | | | | | |
| RELEASE AGENT 9 | CITRIC ACID | 3 | 3 | 10 | | 6.4 | 4.9 | 88.7 | |
| RELEASE AGENT 10 | CITRIC ACID | 3 | 3 | 12 | | | 5.8 | 2.8 | 91.4 |
| RELEASE AGENT 11 | PROPANE-1,2,3-TRICARBOXYLIC ACID | 3 | 3 | 16 | | | | | 6.4 |
| RELEASE AGENT 12 | PROP-1-ENE-1,2,3-TRICARBOXYLIC ACID | 3 | 3 | 18 | | | | | |
| RELEASE AGENT 13 | TETRA CARBOXY METHANE | 1 | 4 | 14 | | | | 3.7 | 1.5 |
| RELEASE AGENT 14 | TRIMELLITIC ACID | 6 | 3 | 12 | | | 7.1 | 5.1 | 87.8 |

TABLE 1-continued

| | | | | | | | | | |
|---|---|---|---|---|---|---|---|---|---|
| RELEASE AGENT 15 | PYROMELLITIC ACID | 6 | 4 | 24 | | | | | |
| COMPARATIVE AGENT 1 | CITRIC ACID | 3 | 3 | 20 | | | | | |
| COMPARATIVE AGENT 2 | CITRIC ACID | 3 | 3 | 20 | | | | | |
| COMPARATIVE AGENT 3 | CITRIC ACID | 3 | 3 | 20 | | | | | |
| COMPARATIVE AGENT 4 | CITRIC ACID | 3 | 3 | 8 | 5.2 | 1.4 | 93.4 | | |
| COMPARATIVE AGENT 5 | CITRIC ACID | 3 | 3 | 32 | | | | | |
| COMPARATIVE AGENT 6 | CITRIC ACID | 3 | 3 | 20 | | | | | |
| COMPARATIVE AGENT 7 | CITRIC ACID | 3 | 3 | 20 | | | | | |
| COMPARATIVE AGENT 8 | CITRIC ACID | 3 | 3 | 20 | | | | | |
| COMPARATIVE AGENT 9 | CITRIC ACID | 3 | 3 | 20 | | | | | |

| RELEASE AGENT | ALCOHOL COMPONENT CONTENT PERCENTAGE, PERCENT BY MASS | | | | | | | | | |
|---|---|---|---|---|---|---|---|---|---|---|
| | C14 | C16 | C18 | C20 | C22 | C24 | C26 | C28 | C30 | C32 |
| RELEASE AGENT 1 | | 5.8 | 3.9 | 90.3 | | | | | | |
| RELEASE AGENT 2 | | | 13 | 6.3 | 80.7 | | | | | |
| RELEASE AGENT 3 | | | 3.5 | 0.1 | 96.4 | | | | | |
| RELEASE AGENT 4 | | | 5.7 | 2.9 | 91.4 | | | | | |
| RELEASE AGENT 5 | | | 10.5 | 4.4 | 85.1 | | | | | |
| RELEASE AGENT 6 | | | 5.2 | 1.4 | 93.4 | | | | | |
| RELEASE AGENT 7 | | | | | | 5.7 | 2.9 | 91.4 | | |
| RELEASE AGENT 8 | | | | | | | 8.6 | 0 | 91.4 | |
| RELEASE AGENT 9 | | | | | | | | | | |
| RELEASE AGENT 10 | | | | | | | | | | |
| RELEASE AGENT 11 | 3.9 | 89.7 | | | | | | | | |
| RELEASE AGENT 12 | 5.5 | 3.6 | 90.9 | | | | | | | |
| RELEASE AGENT 13 | 94.8 | | | | | | | | | |
| RELEASE AGENT 14 | | | | | | | | | | |
| RELEASE AGENT 15 | | | | 5.9 | 3.9 | 90.2 | | | | |
| COMPARATIVE AGENT 1 | | | | 100 | | | | | | |
| COMPARATIVE AGENT 2 | | 3.9 | 5.9 | 90.2 | | | | | | |
| COMPARATIVE AGENT 3 | | 5.1 | 5.1 | 89.8 | | | | | | |
| COMPARATIVE AGENT 4 | | | | | | | | | | |
| COMPARATIVE AGENT 5 | | | | | | | | 10.5 | 4.4 | 85.1 |
| COMPARATIVE AGENT 6 | | 2.9 | 7.9 | 89.2 | | | | | | |
| COMPARATIVE AGENT 7 | | 3.9 | 5.9 | 90.2 | | | | | | |
| COMPARATIVE AGENT 8 | | 13.2 | 4.7 | 82.1 | | | | | | |
| COMPARATIVE AGENT 9 | | 12.8 | 7.8 | 79.4 | | | | | | |

(2) Preparation of Release Agents 2 to 15 and Comparative Release Agents 1 to 9

Other than changing the content amount of the carboxylic acid as the acid component and the monohydric alcohol as the alcohol component from the preparation of the release agent 1 so that the carbon number M of the $R_1$ group, carbon number N of the $R_2$ group, content percentage (percent by mass) based on the mass of entire $R_2$s of the alkyl group of the carbon numbers N, N-2, N-4 in the release agent is the value shown in table 1, the release agents 2 to 15 and comparative release agents 1 to 9 were prepared by a process similar to that of the release agent 1.

(3) Preparation of Core Resin Particle 1

11.3 parts by mass of an anion surfactant agent (Emaru E27C, Kao Corporation, active component 27 percent) was dissolved in 1107.05 parts by mass of pure water and the temperature was maintained at 80° C. 201.5 parts by mass of styrene, 117.24 parts by mass of n-butyl acrylate, 18.31 parts by mass of methacrylic acid, 117.2 parts by mass of the release agent 1 (melting point 75.6° C.) and 12.4 parts by mass of behenyl alcohol was put into a different container and heating was started. The heated solution was added to the above surfactant solution and high speed agitation was performed using Clearmix (manufactured by M Technique Co., Ltd.) to prepare a monomer emulsified liquid.

Agitation was performed while maintaining the internal temperature and an aqueous solution of polymerization initiator was added where 11.41 parts by mass of potassium persulfate was dissolved in 216.72 parts by mass of pure water and another 5 minutes was used to drop 5.23 parts by mass of n-octyl mercaptan. Then, polymerization was performed for 40 minutes at the same temperature to obtain core resin particle 1.

(4) Core Resin Particles 2 to 15, Comparative Core Resin Particles 1 to 9

Other than changing the release agent used as shown in the table 2 below from the preparation of the core resin particle 1, the core resin particles 2 to 15 and comparative core resin particles 1 to 9 were obtained by a process similar to the preparation of the core resin particle 1.

(5) Preparation of Shell Resin Particle 2948 parts by mass of pure water and 2.3 parts by mass of an anion surfactant agent (Emaru 2FG, Kao Corporation) were dissolved in a five liter stainless steel reactor including an agitating device, cooling tube, nitrogen introduction tube and temperature sensor. The solution was maintained at 80° C. under a nitrogen stream and while performing agitation, an aqueous solution of a polymerization initiator was added where 10.2 parts by mass of potassium persulfate was dissolved in 218 parts by mass of pure water. Further, 520 parts by mass of styrene, 184 parts by mass of n-butyl acrylate, 96 parts by mass of methacrylic acid, 22.1 parts by mass of n-octyl mercaptan were mixed in the monomer solution and after the monomer solution was dripped for 3 hours, the temperature was maintained for 1 hour to complete the polymerization. Then, the inner temperature was cooled to ambient temperature and the shell resin particle was obtained.

(6) Preparation Cyan Coloring Agent Dispersion Liquid

After gradually adding 25 parts by mass of cyan pigment C.I. Pigment Blue 15:3 (copper phthalocyanine pigment) to a surfactant agent solution (a solution of 11.5 parts by mass of n-sodium dodecyl sulfate dissolved in 160 parts by mass of pure water), Clearmix W-Motion CLM-0.8 (manufactured by M Technique Co., Ltd.) is used for dispersion processing to obtain a cyan pigment dispersion liquid with 138 nm as a volumetric average particle diameter.

2. Manufacturing Toner (1) Manufacturing Toner 1 of the Present Example 1461.42 parts by mass of the core resin particle 1, 1671.4 parts by mass of pure water, 147.31 parts by mass of cyan coloring agent dispersion liquid was put into a stainless steel reactor including an agitating device, cooling tube and temperature sensor and while performing agitation, pH was adjusted to 10 by using a 5N-sodium hydroxide aqueous solution. Next, under agitation, a magnesium chloride aqueous solution where 56.66 parts by mass of magnesium chloride hexahydrate was dissolved in 56.66 parts by mass of pure water was dripped for 10 minutes. The temperature was raised until the inner temperature was 75° C., and the particle diameter was measured using the Coulter TA3 (manufactured by Beckman Coulter, Inc.) and heating and agitation was performed until the median diameter on a volumetric basis was 6.5 μm. When the median diameter on a volumetric basis reached 6.5 μm, 244.18 parts by mass of the shell resin particle adjusted to pH=4 by the 5N-sodium hydroxide aqueous solution was dripped and the heating agitation continued until the shell resin particle attached to the core particle surface on which the core resin particle 1 and cyan coloring agent was flocculated and fused.

A small amount of reaction solution was separated by centrifugation using a centrifugal separator and when the supernatant became transparent, sodium chloride aqueous solution was added where 73 parts by mass of sodium chloride was dissolved in 291.98 parts by mass of pure water. Heating agitation was performed using a flow particle image analyzer FPIA 2100 (manufactured by SYSMEX CORPORATION), and when the average degree of circularity reached 0.965, the inner temperature was cooled to ambient temperature. After cleaning by pure water and filtering were repeated on the obtained particle, the particle was dried with hot air of 30° C. and the toner 1 of the present example was obtained.

(2) Manufacturing of Toners 2 to 15 of the Present Example and Toners 1 to 9 of the Comparative Examples Other than changing the core resin particle 1 to core resin particle 2 to 15 or comparative core resin particle 1 to 9 as shown in table 2 from the manufacturing of the toner 1 of the present example, the toners 2 to 15 of the present example and comparative toners 1 to 9 of the comparative example were each made by a process similar to that of the toner 1 of the present example.

(3) Addition of External Additive

External additive processing was performed on each of the manufactured toners 1 to 15 of the present example and the comparative toners 1 to 9 of the comparative examples.

In the external additive processing, the following external additives were added to 100 parts by mass of each toner and mixing processing was performed for 10 minutes in a 5 L Henschel mixer (manufactured by MITSUI MIIKE MACHINERY CO., LTD.). Further, sifting was performed using a screen with a mesh opening size 45 μm by a wind power screen classifier "Hibolter NR300" (manufactured by TOKYO KIKAI SEISAKUSHO, LTD.).

Cerium oxide particle (median diameter on a volumetric basis 0.55 μm): 2.5 parts by mass Titanium oxide particle (dodecyltrimethoxysilane processing performed, median diameter on a volumetric basis 30 nm): 0.8 parts by mass Silica particle (hexamethyldisilazane processing performed, median diameter on a volumetric basis 100 nm): 1.2 parts by mass (4) Preparation of Developer Next, in order to prepare the developer, in a ferrite core with a particle diameter of 35 μm, 0.8 percent by mass in mass ratio of silicone resin "SR2411" (manufactured by Dow Corning Toray Co., Ltd.) was added thereto, and a carrier was made by performing coating processing using a kneader apparatus.

After the external additive processing was performed on the toners 1 to 15 of the present example, and the comparative toners 1 to 9 of the comparative example, mixing processing with the carriers made was performed on each toner and two component developers of each toner was made. The content amount was 7 parts by mass of each toner and 93 parts by mass of the made carrier and a V-type blender was used in the mixing processing.

3. Evaluation Experiment (1) Evaluation of Document Offset

Successive double face printing of the image for evaluation was performed on 200 sheets with the above described full color high speed multifunction peripheral. The evaluation image is an image with a background image where the full-page is half-tone with a density of 20 percent, and 36 lines of characters with a size of 6.0 points positioned on the background, and the evaluation image was printed on both faces of the paper. The 200 sheets of printed paper were arranged as they were on a marble table and a weight was placed on the overlapping portion of the paper so that the applied pressure would be the equivalent to 19.6 kPa (200 g/cm$^2$). After leaving the paper in this state in an environment where the temperature was 30° C. and humidity was 60 percent RH for 3 days, the degree of image loss on the toner image of each overlapped sheet was evaluated.

The evaluation standard is as follows.

Excellent: A level which shows that image defect due to shifting of toner and toner images slightly sticking to each other were not seen and there was no problem of image loss at all.

Good: A level which shows that when each sheet of the overlapped printed paper was taken off one by one, there was a crisp sound, but there was no image failure and no problem of image loss.

Allowable: A level which shows that when each sheet of the overlapped printed paper was taken off one by one, some small gloss unevenness occurred on the toner image but there was no image failure and it was determined that there was hardly any problem of image loss.

Poor: A level which shows that directly after printing, toner shifting from the character portion to the area of the background where there were no characters could be seen and shifting of toner to the character area resulting in a stain could also be seen.

(2) Evaluation of Evenness of Gloss

A commercially available digital multifunctional peripheral "bizhub PRO C500" (manufactured by Konica Minolta Business Technologies, Inc.) was used to form a toner image with a degree of gloss from 75 or more to less than 80 with an attached amount of 0.4 g/m$^2$ of cyan toner on a color recording paper "POD film coat S 198 g/m2" (manufactured by Oji Paper Co., Ltd.) for on-demand printing when the surface temperature of the heating roller of the fixing device is 150° C. The degree of gloss was measured using a "Gloss Meter" (manufactured by Murakami Color Research Laboratory) where the incidence angle was set at 75°. The measurement was performed at 50 points in the center section, starting edge, and end edge of the measured image and the variation coefficient of the degree of gloss was measured. The smaller variation coefficient shows the gloss is more even. A variation coefficient less than 2 percent was considered to be acceptable.

4. Evaluation Result

The evaluation result is shown in table 2.

TABLE 2

| | TONER | CORE RESIN | RELEASE AGENT | DOCUMENT OFFSET | GLOSS EVENNESS |
|---|---|---|---|---|---|
| EXAMPLE | TONER 1 | CORE RESIN PARTICLE 1 | RELEASE AGENT 1 | EXCELLENT | 0.4% |
| | TONER 2 | CORE RESIN PARTICLE 2 | RELEASE AGENT 2 | GOOD | 1.7% |
| | TONER 3 | CORE RESIN PARTICLE 3 | RELEASE AGENT 3 | GOOD | 1.9% |
| | TONER 4 | CORE RESIN PARTICLE 4 | RELEASE AGENT 4 | EXCELLENT | 0.2% |
| | TONER 5 | CORE RESIN PARTICLE 5 | RELEASE AGENT 5 | GOOD | 0.5% |
| | TONER 6 | CORE RESIN PARTICLE 6 | RELEASE AGENT 6 | GOOD | 0.6% |
| | TONER 7 | CORE RESIN PARTICLE 7 | RELEASE AGENT 7 | GOOD | 0.8% |
| | TONER 8 | CORE RESIN PARTICLE 8 | RELEASE AGENT 8 | GOOD | 1.7% |
| | TONER 9 | CORE RESIN PARTICLE 9 | RELEASE AGENT 9 | GOOD | 1.9% |
| | TONER 10 | CORE RESIN PARTICLE 10 | RELEASE AGENT 10 | GOOD | 1.2% |
| | TONER 11 | CORE RESIN PARTICLE 11 | RELEASE AGENT 11 | EXCELLENT | 0.2% |
| | TONER 12 | CORE RESIN PARTICLE 12 | RELEASE AGENT 12 | EXCELLENT | 0.1% |
| | TONER 13 | CORE RESIN PARTICLE 13 | RELEASE AGENT 13 | GOOD | 0.6% |
| | TONER 14 | CORE RESIN PARTICLE 14 | RELEASE AGENT 14 | GOOD | 0.5% |
| | TONER 15 | CORE RESIN PARTICLE 15 | RELEASE AGENT 15 | GOOD | 0.6% |
| COMPARATIVE EXAMPLE | COMPARATIVE TONER 1 | COMPARATIVE CORE RESIN PARTICLE 1 | COMPARATIVE RELEASE AGENT 1 | POOR | 0.8% |
| | COMPARATIVE TONER 2 | COMPARATIVE CORE RESIN PARTICLE 2 | COMPARATIVE RELEASE AGENT 2 | POOR | 3.5% |
| | COMPARATIVE TONER 3 | COMPARATIVE CORE RESIN PARTICLE 3 | COMPARATIVE RELEASE AGENT 3 | POOR | 3.1% |
| | COMPARATIVE TONER 4 | COMPARATIVE CORE RESIN PARTICLE 4 | COMPARATIVE RELEASE AGENT 4 | POOR | 3.4% |
| | COMPARATIVE TONER 5 | COMPARATIVE CORE RESIN PARTICLE 5 | COMPARATIVE RELEASE AGENT 5 | POOR | 4.4% |
| | COMPARATIVE TONER 6 | COMPARATIVE CORE RESIN PARTICLE 6 | COMPARATIVE RELEASE AGENT 6 | POOR | 3.9% |
| | COMPARATIVE TONER 7 | COMPARATIVE CORE RESIN PARTICLE 7 | COMPARATIVE RELEASE AGENT 7 | POOR | 2.8% |

TABLE 2-continued

| TONER | CORE RESIN | RELEASE AGENT | DOCUMENT OFFSET | GLOSS EVENNESS |
|---|---|---|---|---|
| COMPARATIVE TONER 8 | COMPARATIVE CORE RESIN PARTICLE 8 | COMPARATIVE RELEASE AGENT 8 | POOR | 2.5% |
| COMPARATIVE TONER 9 | COMPARATIVE CORE RESIN PARTICLE 9 | COMPARATIVE RELEASE AGENT 9 | POOR | 2.8% |

As shown in table 2, the evaluation of document offset of the toners 1 to 15 of the present embodiment are all excellent or good, and document offset could be prevented. Also, as for the evenness of gloss, the toners 1 to 15 of the present embodiment all achieved the acceptable standard of 2 percent or less of variation coefficient. On the other hand, as for the toners 1 to 9 of the comparative example, document offset occurred and also the variation coefficient was mostly 2 percent or more and gloss unevenness occurred.

According to an aspect of the preferred embodiments of the present invention, there is provided a toner for developing an electrostatic latent image including:

a resin;

a coloring agent and a release agent comprising a compound or compounds represented by the following general formula (1):

$$R_1—(COO—R_2)_n$$

wherein $R_1$ shown in the general formula (1) is a linking group having carbon number of 2 to 8 which may be a cyclic structure and may have a hydroxy group or fatty acid ester group; and each $R_2$ shown in the general formula (1) is an alkyl group having carbon number of N, (N-2) or (N-4) independently, N is a natural number from 10 to 30, and n is a natural number from 3 to 4, wherein $R_2$ with carbon number of N is 80 to 97 percent by mass based on the mass of total $R_2$s in the release agent, $R_2$ with carbon number of (N-2) is 0.0 to 7.8 percent by mass based on the mass of total $R_2$s in the release agent, $R_2$ with carbon number of (N-4) is 3.0 to 13.0 percent by mass based on the mass of total $R_2$s in the release agent;

$R_2$ with carbon number of (N-4) is included 1.5 percent by mass or more than $R_2$ with carbon number of (N-2) in the release agent.

Preferably, in the toner for developing an electrostatic latent image, the release agent comprises a mixture of compounds represented by the following general formulae (1a), (1b) or (1c);

(1a)

$$\begin{array}{l} COO—R_{2(N)} \\ | \\ R_1—COO—R_{2(N)} \\ | \\ COO—R_{2(N)} \end{array}$$

(1b)

$$\begin{array}{l} COO—R_{2(N-2)} \\ | \\ R_1—COO—R_{2(N-2)} \\ | \\ COO—R_{2(N-2)} \end{array}$$

-continued (1c)

$$\begin{array}{l} COO—R_{2(N-4)} \\ | \\ R_1—COO—R_{2(N-4)} \\ | \\ COO—R_{2(N-4)} \end{array}$$

wherein $R_1$ is a linking group having carbon number of 2 to 8 which may be a cyclic structure and may have a hydroxy group or fatty acid ester group, $R_{2(N)}$ is an alkyl group with carbon number of N, $R_{2(N-2)}$ is an alkyl group with carbon number of N-2, $R_{2(N-4)}$ is an alkyl group with carbon number of N-4, and N is a natural number from 10 to 30.

Preferably, in the toner for developing an electrostatic latent image, the release agent comprises a compound represented by the following general formulae (1d), (1e) or (1f);

(1d)

$$\begin{array}{l} COO—R_{2(N)} \\ | \\ R_1—COO—R_{2(N-2)} \\ | \\ COO—R_{2(N-4)} \end{array}$$

(1e)

$$\begin{array}{l} COO—R_{2(N)} \\ | \\ R_1—COO—R_{2(N)} \\ | \\ COO—R_{2(N-2)} \end{array}$$

(1f)

$$\begin{array}{l} COO—R_{2(N)} \\ | \\ R_1—COO—R_{2(N)} \\ | \\ COO—R_{2(N-4)} \end{array}$$

wherein $R_1$ is a linking group having carbon number of 2 to 8 which may be a cyclic structure and may have a hydroxy group or fatty acid ester group, $R_{2(N)}$ is an alkyl group with carbon number of N, $R_{2(N-2)}$ is an alkyl group with carbon number of N-2, $R_{2(N-4)}$ is an alkyl group with carbon number of N-4, and N is a natural number from 10 to 30.

Preferably, in the toner for developing an electrostatic latent image, the release agent comprises a mixture of compounds represented by the following general formulae (1a), (1b), (1c), (1d), (1e) or (1f);

(1a)

$$\begin{array}{l} COO—R_{2(N)} \\ | \\ R_1—COO—R_{2(N)} \\ | \\ COO—R_{2(N)} \end{array}$$

-continued (1b)

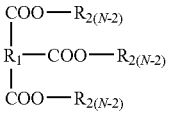

(1c)

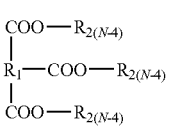

(1d)

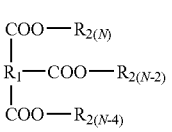

(1e)

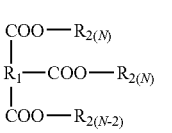

(1f)

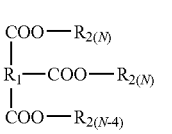

wherein $R_1$ is a linking group having carbon number of 2 to 8 which may be a cyclic structure and may have a hydroxy group or fatty acid ester group, $R_{2(N)}$ is an alkyl group with carbon number of N, $R_{2(N-2)}$ is an alkyl group with carbon number of N-2, $R_{2(N-4)}$ is an alkyl group with carbon number of N-4, and N is a natural number from 10 to 30.

Preferably, in the toner for developing an electrostatic latent image, the release agent is composed by a multivalent carboxylic acid, a monohydric alcohol with carbon number of N, a monohydric alcohol with carbon number of N-2 and a monohydric alcohol with carbon number of N-4, wherein N is a natural number from 10 to 30.

According to the toner of the present embodiment, an image with enhanced evenness of gloss can be obtained and toner with enhanced document offset properties can be provided. Although it is difficult to clarify the mechanism, the release agent used in conventional toner is manufactured industrially including more of an alkyl group with carbon number (N-2) than an alkyl group with carbon number (N-4). In the present embodiment, the content percentage of the alkyl group of the carbon number (N-2) is reduced by design to less than the alkyl group of the carbon number (N-4) and thus the outstanding effects were found and the present embodiment was derived. It is presumed that in the release agent used in the toner of the present embodiment, the carbon number distribution of the $R_2$ group is controlled within a certain range, and thus after the fixing processing, the crystallization of the release agent due to cooling of the image formed on the paper with toner was suppressed and the gloss was equalized.

Although various exemplary embodiments have been shown and described, the invention is not limited to the embodiments shown. Therefore, the scope of the invention is intended to be limited solely by the scope of the claims that follow and not by the above explanation, and it is intended that the present invention covers modifications and variations that come within the scope of the appended claims and their equivalents.

The present U.S. patent application claims priority under the Paris Convention of Japanese Patent Application No. 2009-004501 filed on Jan. 13, 2009 to the Japanese Patent Office, which shall be a basis for correcting mistranslations.

What is claimed is:

1. A toner for developing an electrostatic latent image comprising:

a resin;

a coloring agent and a release agent comprising a compound or compounds represented by the following general formula (1):

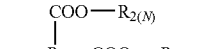

wherein $R_1$ shown in the general formula (1) is a linking group having carbon number of 2 to 8 which may be a cyclic structure and may have a hydroxy group or fatty acid ester group; and each $R_2$ shown in the general formula (C1) is an alkyl group having carbon number of N, (N-2) or (N-4) independently, N is a natural number from 10 to 30, and n is a natural number from 3 to 4, wherein $R_2$ with carbon number of N is 80 to 97 percent by mass based on the mass of total $R_2$s in the release agent, $R_2$ with carbon number of (N-2) is 0.0 to 7.8 percent by mass based on tho mass of total $R_2$s in the release agent, $R_2$ with carbon number of (N-4) is 3.0 to 13.0 percent by mass based on the mass of total $R_2$s in the release agent;

$R_2$ with carbon number of (N-4) is included 1.5 percent by mass or more than $R_2$ with carbon number of (N-2) in the release agent.

2. The toner for developing an electrostatic latent image of claim 1, wherein the release agent comprises a mixture of compounds represented by the following general formulae (1a), (1b) and (1c);

(1a)

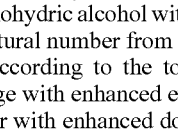

(1b)

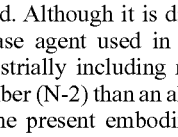

(1c)

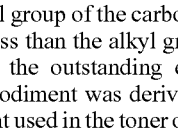

wherein $R_1$ is a linking group having carbon number of 2 to 8 which may be a cyclic structure and may have a hydroxy group or fatty acid ester group, $R_{2(N)}$ is an alkyl group with carbon number of N, $R_{2(N-2)}$ is an alkyl group with carbon number of N-2, $R_{2(N-4)}$ is an alkyl group with carbon number of N-4, and N is a natural number from 10 to 30.

3. The toner for developing an electrostatic latent image of claim 1, wherein the release agent comprises a compound represented by the following general formulae (1d), (1e) and (1f);

(1d)

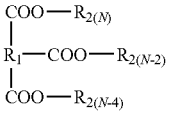

(1e)

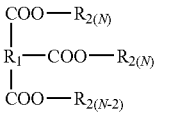

(1f)

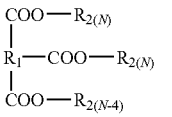

wherein $R_1$ is a linking group having carbon number of 2 to 8 which may be a cyclic structure and may have a hydroxy group or fatty acid ester group, $R_{2(N)}$ is an alkyl group with carbon number of N, $R_{2(N-2)}$ is an alkyl group with carbon number of N-2, $R_{2(N-4)}$ is an alkyl group with carbon number of N-4, and N is a natural number from 10 to 30.

4. The toner for developing an electrostatic latent image of claim 1, wherein the release agent comprises a mixture of compounds represented by the following general formulae (1a), (1b), (1c), (1d), (1e) and (1f);

(1a)

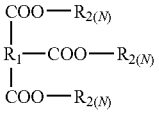

(1b)

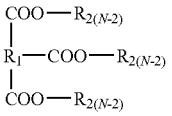

-continued (1c)

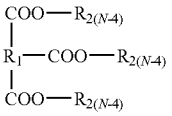

(1d)

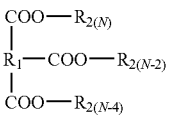

(1e)

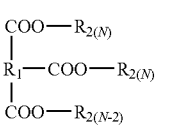

(1f)

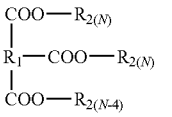

wherein $R_1$ is a linking group having carbon number of 2 to 8 which may be a cyclic structure and may have a hydroxy group or fatty acid. ester group, $R_{2(N)}$ is an alkyl group with carbon number of N, $R_{2(N-2)}$ is an aakyl group with carbon number of N-2, $R_{2(N-4)}$ is an alkyl group with carbon number of N-4, and N is a natural number from 10 to 30.

5. The toner for developing an electrostatic latent image of claim 1, wherein the release agent is composed by a multivalent carboxylic acid, a monohydric alcohol with carbon number of N, a monohydric alcohol with carbon number of N-2 and a monohydric alcohol with carbon number of N-4, wherein N is a natural number from 10 to 30.

* * * * *